US006877811B1

(12) United States Patent
Garelick

(10) Patent No.: US 6,877,811 B1
(45) Date of Patent: Apr. 12, 2005

(54) RELEASEABLE LOCKING MECHANISM FOR ROTATABLE BOAT SEAT

(75) Inventor: Richard J. Garelick, Minneapolis, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 0 days.

(21) Appl. No.: 10/802,311

(22) Filed: Mar. 18, 2004

(51) Int. Cl.[7] ..... A47C 3/18
(52) U.S. Cl. ..... 297/344.22; 248/418
(58) Field of Search ..... 297/344.21, 344.22, 297/344.26; 248/131, 415, 418, 425

(56) References Cited

U.S. PATENT DOCUMENTS 723,465 A * 3/1903 Hornung, Jr. ..... 297/344.22
2,673,592 A * 3/1954 Caramelli ..... 248/416
3,975,050 A * 8/1976 McKee ..... 248/418
4,951,328 A * 8/1990 Potvin ..... 297/344.24
5,882,076 A 3/1999 Garelick et al. ..... 297/344.18
5,884,887 A 3/1999 Garelick et al. ..... 248/423
6,116,183 A * 9/2000 Crow et al. ..... 297/344.22

OTHER PUBLICATIONS

Garelick Product Catalog © 2001 pp. 33.

* cited by examiner

*Primary Examiner*—Peter R. Brown
(74) *Attorney, Agent, or Firm*—Jacobson and Johnson

(57) ABSTRACT

A boat seat is rotatably supported on a hollow, tubular, deck-mounted support post or column by a yoke or spider. A radially movable locking plate is biased by a spring member to rotatably lock the yoke in place and a lever arm can be operated to move the locking plate in opposition to the force of the spring member out of locking engagement to permit the seat to be rotatably adjusted.

5 Claims, 5 Drawing Sheets

RELEASEABLE LOCKING MECHANISM FOR ROTATABLE BOAT SEAT

FIELD OF THE INVENTION

This invention is aimed at adjustable boat seats which are mounted at the top of a pedestal or pillar or post which is anchored at the bottom to a suitable support usually the deck of the boat. More specifically, it is aimed at providing a mechanism for releasably locking a boat seat in place after it has been adjustably rotated or swung in a desired direction by the occupant of the boat seat.

DESCRIPTION OF THE PRIOR ART

U.S. Pat. No. 5,882,076 dated Mar. 16, 1999 assigned to the same assignee as the instant application relates to the same function and purpose as the instant application and therefore appears to be the closest prior art that applicants are aware of. Other prior art which preceded the invention covered by the '076 patent is described in the aforementioned patent and the prior art description contained therein is incorporated herein by reference for the purpose of describing the known most pertinent prior art.

SUMMARY OF THE INVENTION

To some significant degree the instant invention is similar to the invention described in the aforementioned '076 patent. A yoke or spider has an upper horizontal plate member for attachment or coupling to the underside of a boat seat and an annular or tubular downwardly extending section for engaging a vertically disposed hollow pedestal or cylindrical support post or pillar. A sleeve-like insert which has teeth in the form of circumferentially spaced vertical or lengthwise slots or grooves around its exterior is located within the tubular extended section of the spider or yoke for locking onto the supporting pedestal. Ordinarily the yoke is rotatable or swivable with respect to the insert so it is free to be maneuvered to face in a direction desired by the occupant of the seat. For locking the seat when it is facing in the desired direction, there is an opening in the wall of the yoke's annular extension in which a toothed or ribbed locking plate can be moved to engage or lock onto the teeth on the aforementioned insert. A radially extending lever arm is pivotally attached to the yoke and has one end engaging the locking plate and a handle at the outer end. The locking plate is slidably engaged in the opening in the yoke annular section and is biased radially inwardly by a spring member for engaging the insert's teeth to lock the yoke against any further rotational movement with respect to the pedestal. To rotationally adjust the seat the handle of the lever arm is moved which, by mechanical arrangement, pulls or retracts the locking plate from its engagement with the insert and while held in this position the seat can be swiveled or rotated to a new position. When the handle of the lever arm is released, the spring force moves the locking plate to again engage the teeth of the insert to lock the seat in place.

The locking mechanism illustrated in the aforementioned '076 patent has an end of the extending lever arm contacting a resilient pad on the back or the outer side of the locking plate to hold the locking plate in place with its teeth engaging the slots or grooves or spaces between the teeth on the insert. A spring member is biased to move the locking plate away from engagement. To rotate the seat, the lever arm is moved so that it no longer impinges against the resilient pad on the locking plate and the spring bias acts to move the locking plate away from its locking engagement.

The present invention provides a more secure and positive locking arrangement by biasing the locking plate into secure engagement with the insert and not relying on the end of the lever arm to force and hold the locking plate into the locking engagement. Also, over a period of time a pad is likely to lose some of its resiliency so a locking arrangement which relies on a resilient pad may become less reliable.

DESCRIPTION OF THE PREFERRED EMBODIMENTS

U.S. Pat. No. 5,884,887 tided "LOCK FOR SLIDE ADJUSTMENT OF BOAT SEAT OR TABLE TOP" describes an elevated slidably adjustable boat seat with a positive locking arrangement. The instant invention can be used in conjunction with the aforementioned invention so that the elevated boat seat is not only slidably adjustable and lockable fore and aft in the manner described in the '87 patent but also can be rotatably or swivably adjusted and positively releasably locked facing in the desired direction.

Figure 1:
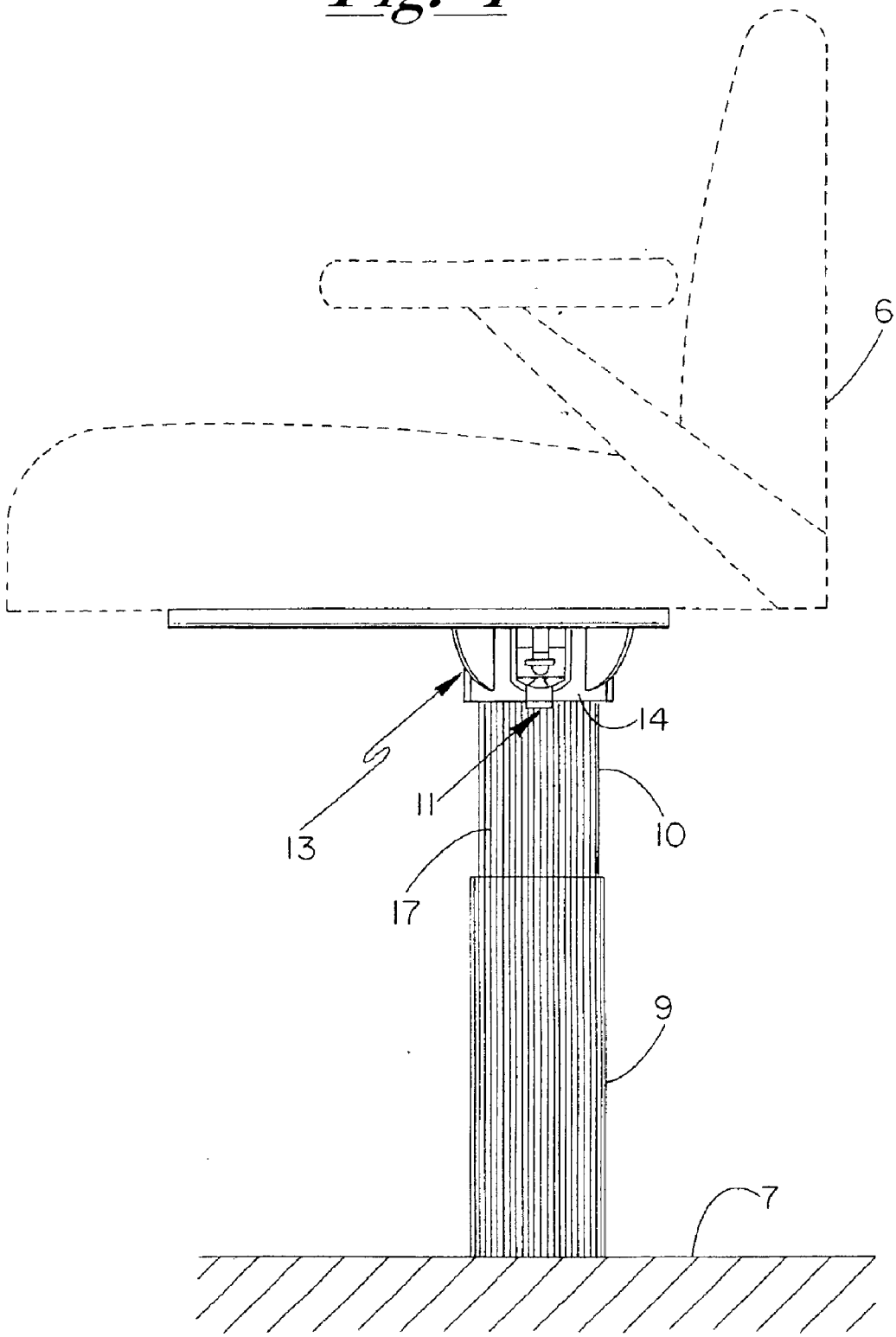
FIG. 1 is a side view illustrating an elevated boat seat in which a preferred embodiment of the invention is utilized.
Figure 2:
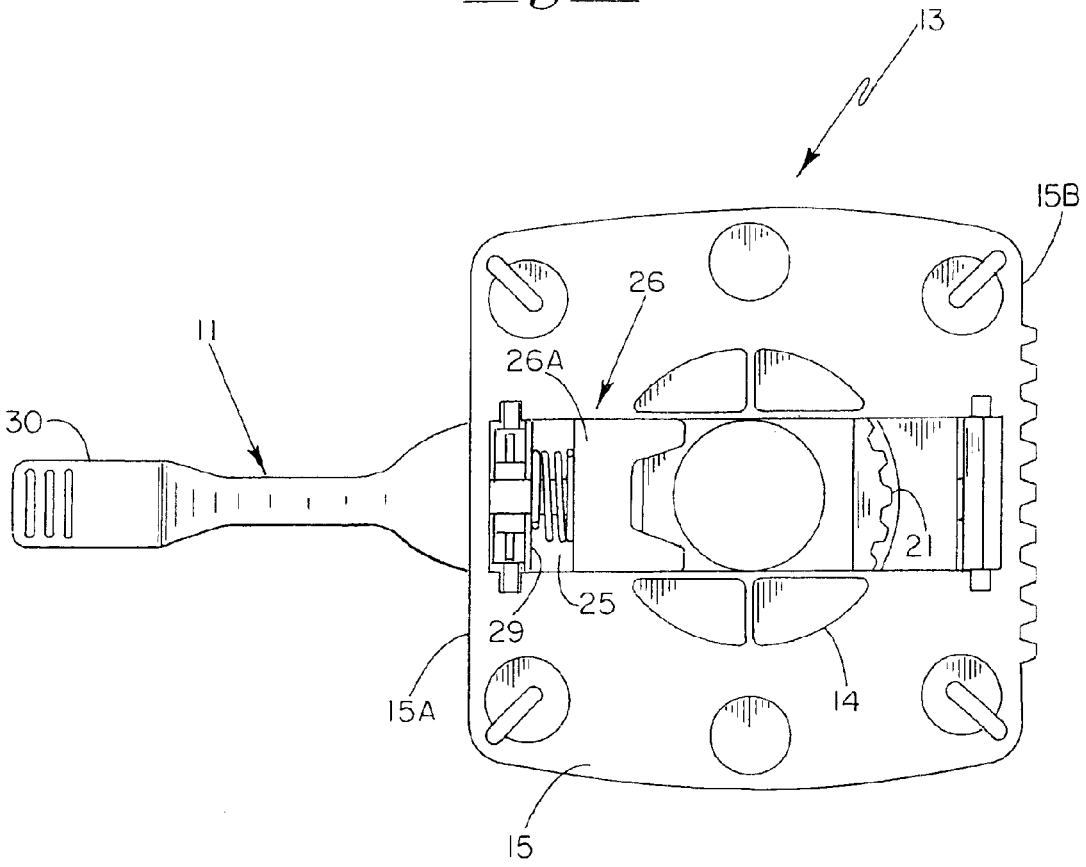
FIG. 2 is a topside view of the boat seat mounting mechanism incorporating a preferred embodiment of the invention.

FIG. 1 illustrates a typical installation in which the instant invention is utilized. Conventionally and traditionally, a rigid circular hollow support post or column 10 extends vertically upward in a telescope arrangement from a tubular supporting pillar 9 which is attached at its base to the boat deck 7. Usually pillar 9 contains a suitable mechanism, not shown, for adjusting the height of column 10 to raise or lower the boat seat 6, shown in dashed line, which is attached at the top end. In some cases the boat seat may be coupled directly to pillar 9 so the boat seat is at a fixed height or elevation. In either case, boat seat 6 is coupled to its support post by a spider or yoke generally identified by reference numeral 13 which is described in greater detail hereinafter. A lever arm 11 extends outward from the underside of the boat seat which can be operated by the user to unlock or disengage the boat seat to allow it to be rotatably or swivably adjusted and to lock the seat when facing in the desired adjusted position.

A spider or yoke 13 is a metal casting, preferably of aluminum, and has a generally centered downwardly projecting section 14 with a centered hollow tubular section 16 for coupling to support post or column 10 and has an integrally cast horizontal upper plate 15. As described in greater detail in the '076 patent plate 15 has parallel side edges 15A and 15B which slidably engage in tracks, not shown, on the side edges of a plate member, not shown, attached to the underside of boat seat 6 for permitting the boat seat to be slidably adjusted fore and aft by the user. The teeth along side edge 15B are for engaging a locking mechanism, not shown, on the boat seat plate for locking the seat in the desired adjusted forward or rearward position.

The exterior surface of the vertical hollow support post or column 10 has a series of closely-spaced ridges and grooves generally designated by reference numeral 17 and its internal annular surface is smooth. A hollow plastic sleeve 18 is telescoped within support column or pedestal 10 at its upper end and has an overhang designated by reference numeral 19 which extends over the upper end of column 10 and overlaps to extend downward over the exterior of a portion at the top of column 10. The inner surface of the overhang portion 19 designated by reference numeral 20 has a series of closely-spaced vertical grooves and ridges which mate with the corresponding grooves and ridges 17 on the outer surface of column 10. This serves to prevent insert 18 from rotating with respect to the support column 10, i.e., the two are rotationally locked together. The outer surface of the overhang section 19 contains a series of circumferentially spaced vertical slots or grooves designated collectively by reference numeral 21 which, as will be described later, provide means for selectively locking the boat seat facing in the desired direction.

Yoke 13 is coupled to the support column 10 with hollow extension 16 telescoped within the interior of plastic sleeve 18 with the underside of the plate 15 effectively resting on top of the upper end of column 10.

Yoke or spider 13 has a passageway generally designated by reference numeral 25 which extends radially outward in section 14. A toothed locking plate 26 is slidably held in the opening 25 by an upper flange 26A and is movable, as will be described later in greater detail, radially inward and outward as desired for its teeth 26B to mesh with or disengage from the teeth 21 of the overhang section 19 of the plastic insert 18. A bar or rod 27 extends radially outward from the back end of locking plate 26 and a coiled spring 28 in compression is wrapped around bar 27 with one end pressing against the back side or the untoothed side of locking plate 26 and the other end of the spring 28 resting against an upward extending stop 29 on spider or yoke 13. In this fashion spring 28 is always in compression urging locking plate 26 radially inward to hold the teeth or grooves and ridges 26B in mesh with the corresponding grooves and ridges 21 of the outer surface of the overhang 19 of the plastic insert 18. Lever 11 has an outer handle 30 and an inner leg 31 arranged at a general right angle and is pivotally engaged at 32 with yoke or spider 13. Extending radially outward from bar 27 is a cross pin 33 which rests in a cutout area on leg 31. With the lever arm in the relaxed or locking position spring 28 acts on locking plate 26 to hold it firmly and securely with the teeth of locking plate 26 firmly in mesh with the corresponding ridges and slots 21. This prevents the yoke and the attached seat from rotating with respect to the support column 10. When the seat occupant grasps handle 30 to move lever arm 11, in the illustrated embodiment, the handle is raised, the fulcrum action of the pivotally attached leg 31 acting on pin 33 pulls bar 27 radially outward and correspondingly locking plate 26 is moved radially outward against the force of compressed spring 28 far enough to disengage the teeth of locking plate 26 from the ridges and valleys 21 thereby permitting the yoke and the attached seat to be rotated with respect to the supporting pillar 10. When the seat is facing in the desired direction the lever arm handle 30 is released and the spring compression takes over to move locking plate 26 radially inward against the ridges and valleys 21. If the teeth 26B do not mesh with the valleys or slots or grooves, the seat occupant merely shifts his or her weight enough to rotate the spider or yoke a small degree until the teeth 26B snap into mesh to lock the yoke and seat in position.

As a further feature, insert 18 has a downward extending tongue section 18A which contains an outward extending button 18B. Button 18B is engaged in a suitable aperture 10A formed in column 10 as a security measure to prevent insert 18 from moving vertically with respect to column 10.

Figure 3:
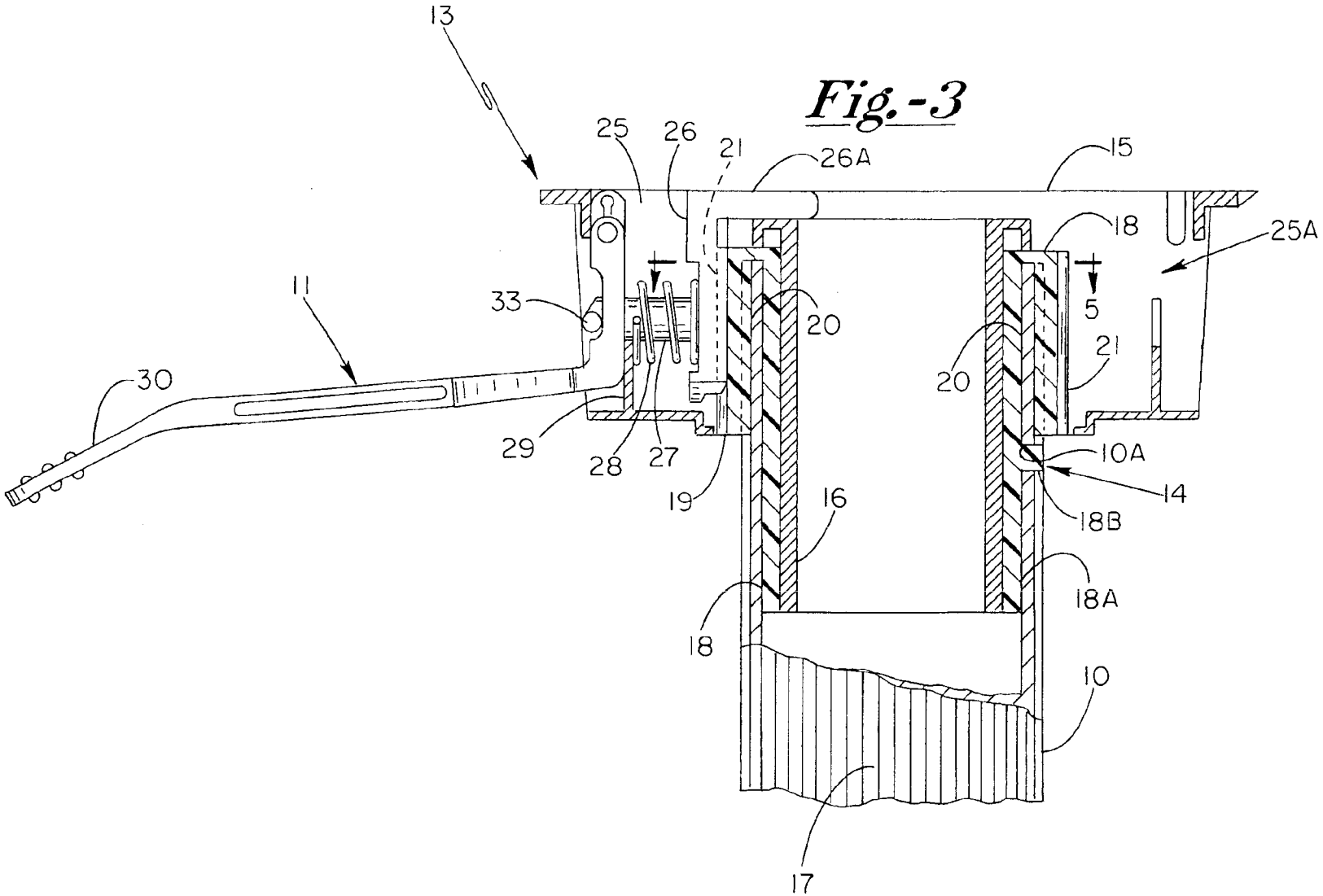
FIG. 3 is a vertical section view illustrating the preferred embodiment of the invention with the seat in the locked condition.
Figure 4:
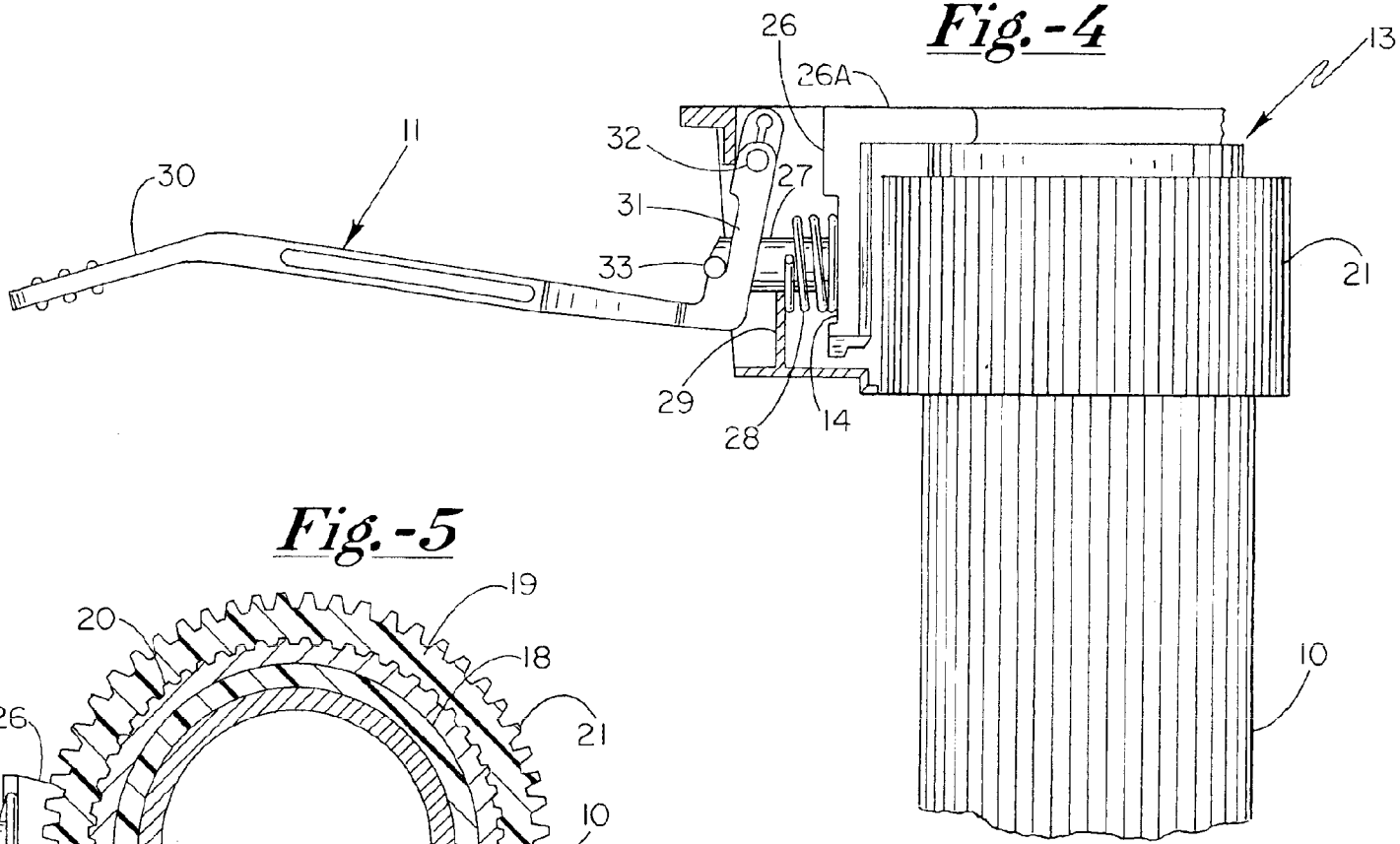
FIG. 4 is a nonsectioned view similar to FIG. 3 illustrating the preferred embodiment of the invention in the released or unlocked condition allowing the seat to be adjusted.
Figure 5:
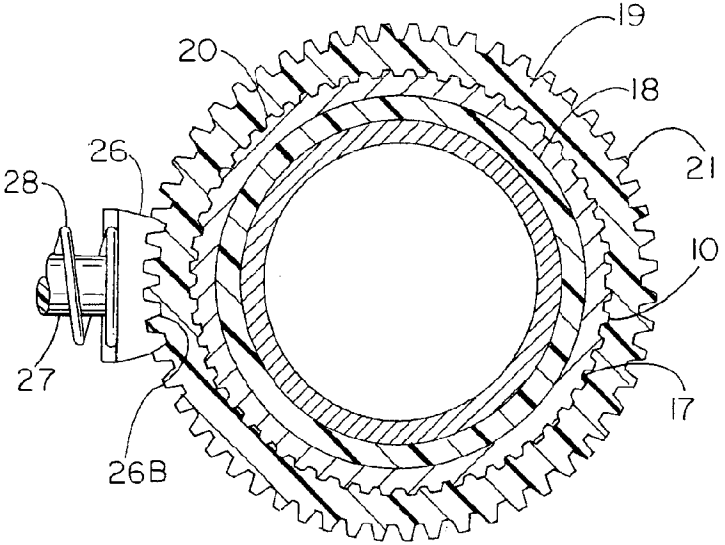
FIG. 5 is a horizontal section illustrating the preferred embodiment in the locked condition.
Figure 6:
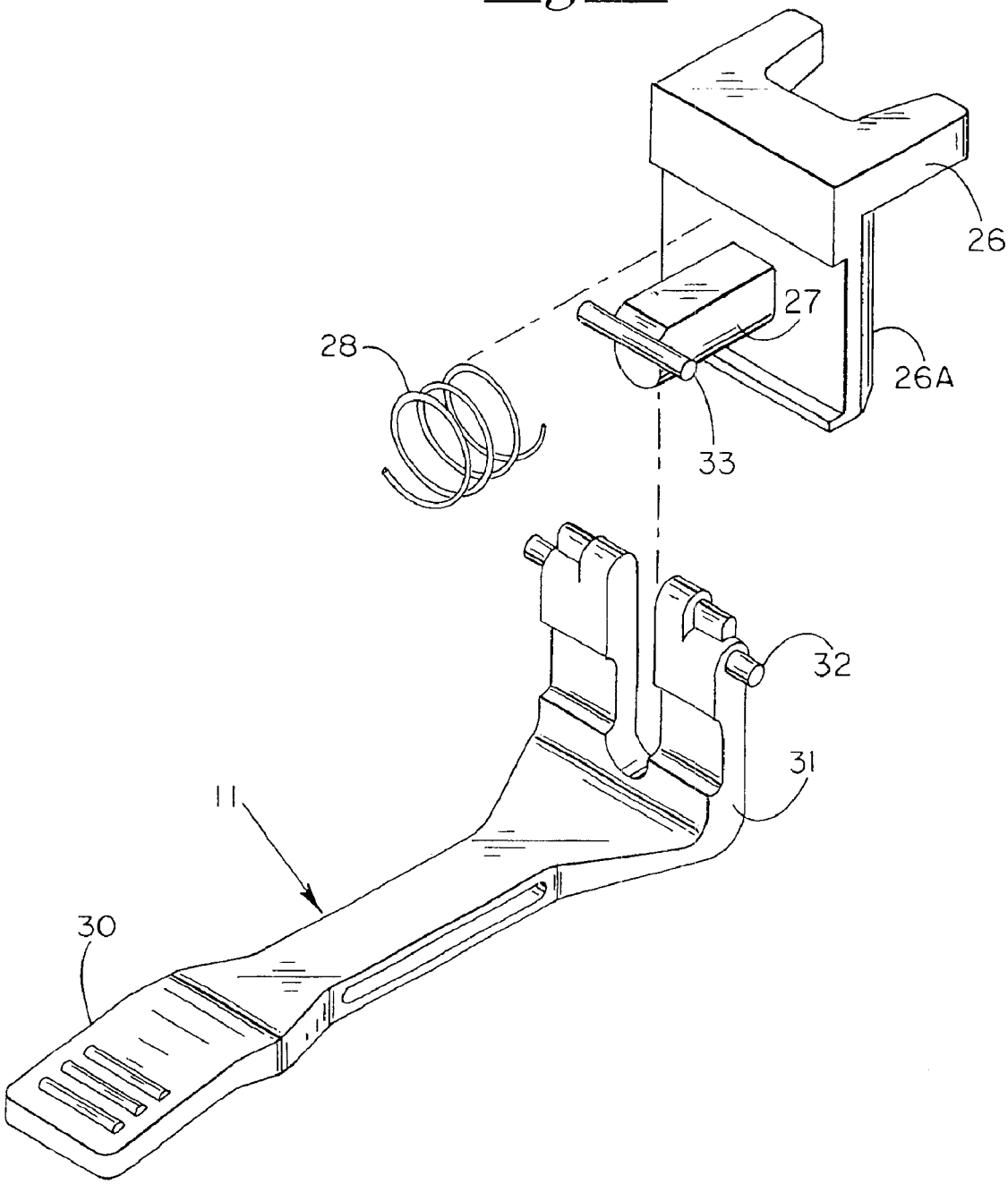
FIG. 6 is a blown-apart view showing some of the detail of the mechanism of the preferred embodiment of the invention.

As illustrated in FIG. 3, spider or yoke 13 preferably is formed with a diametrically opposite area 25*a* to accommodate the above-described locking mechanisms to make it convenient to provide either right-hand or left-hand lever arm control.

I claim:

1. A releasable locking mechanism for a rotatable boat seat comprising:

a vertical hollow rigid tubular support post having a series of circumferentially-spaced vertical grooves and ridges on its outer surface;

a yoke having a horizontal plate for attachment to the underside of a boat seat and a generally centrally located annular section extending below said plate, said section having a generally smooth external surface;

a hollow tubular insert telescoped within said tubular support post at the upper end of said post, said insert having a generally smooth interior annular surface;

said yoke annular section telescoped within said insert interior annular surface;

said insert having an extension at its upper end overhanging the top end of said support post and extending at least part way down the exterior of said support post, the interior surface of said overhang having a series of circumferentially spaced vertically disposed ridges and grooves engaging the corresponding grooves and ridges on said support post for locking said insert from rotation with respect to said support post, and the exterior surface of said overhang having a series of vertically disposed circumferentially spaced ridges and grooves;

a locking plate mounted in said yoke to move radially with respect to said yoke annular extension, said locking plate having a series of vertically disposed spaced-apart ridges and grooves on an inner side for releasably engaging the corresponding ridges and grooves on the outer surface of said insert overhang; and an elongated lever arm pivotally attached to said yoke and extending outward therefrom, said elongated arm coupled to said locking plate for selectively moving said locking plate radially out of engagement with said insert overhang for allowing said yoke to be rotatably moved with respect to said support post.

2. A releasable locking mechanism for a rotatable boat seat as described in claim 1, including:

a spring member coupled to the outer side of said locking plate for applying a force on said locking plate so that its grooves and ridges engage the corresponding ridges and grooves on said insert overhang for rotatably locking said yoke to said support post.

3. A releasable locking mechanism for a rotatable boat seat as described in claim 2 wherein said lever arm is operable to apply a force to said locking plate in opposition to said spring to disengage said locking plate ridges and grooves from said insert ridges and grooves.

4. A releasable locking mechanism for a boat seat as described in claim 3 wherein said elongated lever arm has a handle portion at about its outer end and a leg at about its inner end, said leg coupled to said locking plate to apply a force in opposition to said spring member to disengage said locking plate from said insert for rotatably releasing said yoke from said support post when said handle is moved.

5. A releasable locking mechanism for a boat seat as described in claim 2 wherein said spring member comprises a coiled spring, said spring compressed between a stop plate on said yoke and the back side of said locking plate.

* * * * *